US008544661B1

(12) United States Patent
Melino, Sr. et al.

(10) Patent No.: US 8,544,661 B1
(45) Date of Patent: Oct. 1, 2013

(54) ADJUSTABLE LOWER POLE ASSEMBLY

(76) Inventors: Charles Melino, Sr., Providence, RI (US); Charles Melino, Jr., Cranston, RI (US)

( * ) Notice: Subject to any disclaimer, the term of this patent is extended or adjusted under 35 U.S.C. 154(b) by 0 days.

(21) Appl. No.: 13/284,131

(22) Filed: Oct. 28, 2011

Related U.S. Application Data

(60) Provisional application No. 61/408,567, filed on Oct. 29, 2010.

(51) Int. Cl.
*A47H 1/022* (2006.01)
*A47H 1/102* (2006.01)
*A47H 1/122* (2006.01)

(52) U.S. Cl.
USPC ..... 211/105.6; 211/123

(58) Field of Classification Search
CPC ..... A47K 10/04; A47G 25/0692; A47H 1/02; A47H 1/142; A47H 1/022; A47H 1/10; A47H 1/102; A47H 1/104; A47H 1/14; A47H 1/144; A47H 1/12; A47H 1/122; A47H 1/124
USPC ..... 211/123, 105.1–105.6, 206, 107, 211/16, 87.01, 88.04; 248/251, 200.1; D6/546
See application file for complete search history.

(56) References Cited

U.S. PATENT DOCUMENTS

| | | | | | |
|---|---|---|---|---|---|
| 2,973,870 | A * | 3/1961 | Schoos | 211/123 |
| 3,572,511 | A * | 3/1971 | Triplett | 211/105.6 |
| 3,952,877 | A * | 4/1976 | Kindl | 211/105.5 |
| 4,147,199 | A * | 4/1979 | Cameron | 160/330 |
| 4,488,651 | A * | 12/1984 | Bishop | 211/105.6 |
| 4,744,471 | A * | 5/1988 | Leister | 211/7 |
| 4,895,471 | A * | 1/1990 | Geltz et al. | 403/104 |
| 5,433,551 | A * | 7/1995 | Gordon | 403/377 |
| 5,799,346 | A * | 9/1998 | Tiernan | 4/601 |
| 6,233,877 | B1 * | 5/2001 | Monroe | 52/37 |
| 6,443,318 | B1 * | 9/2002 | Welsch | 211/90.02 |
| 6,824,000 | B2 * | 11/2004 | Samelson | 211/105.3 |
| 7,424,993 | B2 * | 9/2008 | Bell | 248/262 |
| 7,857,151 | B2 * | 12/2010 | Barrese | 211/105.3 |
| 8,215,501 | B2 * | 7/2012 | Trettin et al. | 211/105.2 |
| 2002/0030027 | A1 * | 3/2002 | Welsch | 211/90.02 |
| 2012/0152873 | A1 * | 6/2012 | Didehvar | 211/105.4 |
| 2012/0152874 | A1 * | 6/2012 | Didehvar | 211/105.4 |

* cited by examiner

*Primary Examiner* — Jennifer E Novosad
(74) *Attorney, Agent, or Firm* — Steven N. Fox, Esq.

(57) ABSTRACT

The present invention is an adjustable lower pole assembly for use with an upper pole of a telescopic pole assembly. In one embodiment, the lower pole assembly comprises a pole, a shroud, a spring, and an end cap. The lower end of the pole may be moved downward within the shroud against the spring creating a force in the spring that urges the lower pole upward.

12 Claims, 5 Drawing Sheets

ADJUSTABLE LOWER POLE ASSEMBLY

CROSS-REFERENCE TO RELATED APPLICATIONS

This application is claims priority to U.S. Provisional Application Ser. No. 60/408,567 filed on Oct. 29, 2010, now pending, which is hereby incorporated into this specification by reference in its entirety.

BACKGROUND OF THE INVENTION

Rapid adjustment of the height of a support pole saves valuable time in erecting temporary dust containment walls used in the construction industry. Conventional telescopic pole assemblies employ an upper pole telescopically engaged within a lower pole and a locking unit engagable with the upper pole to fix the overall height at any location. Further means to adjust the overall height of the pole assembly would save additional time when erecting a temporary dust containment wall.

SUMMARY OF THE INVENTION

One object of the present invention is to provide an adjustable lower pole assembly that can be easily mounted to a lower pole of a telescopic pole assembly to further adjust the overall height of the pole assembly.

Another object of the present invention is to provide a kit where an existing lower pole of a pole assembly could be retrofitted in the field to have a height adjustment feature.

The present invention is an adjustable lower pole assembly for use with an upper pole of a telescopic pole assembly. In one embodiment, the adjustable lower pole assembly comprises a pole having a lower end and a stop member engaged with the lower end of the pole. The stop member comprises a flange extending outward of the lower end of the pole. The lower pole assembly further comprises a shroud having an upper end disposed about the lower end of the pole and a lower end extending outward from the lower end of the pole. The shroud further comprises an inner shoulder adapted to engage with the flange of the stop member to prevent the shroud from falling off the lower end of the pole. The shroud further comprises a first passage way extending inward from the upper end of the shroud to the shoulder. The shroud further comprises a second passage way extending inward from the lower end of the shroud to the shoulder. The lower pole assembly further comprises a spring substantially disposed within the second passage way of the shroud. The spring has a lower end and an upper end engaged with the stop member. The lower pole assembly further comprises a cap disposed about the lower end of the shroud and engaged with the lower end of the spring. In use, the lower end of the pole may be moved downward within the second passage way of the shroud against the spring creating a force in the spring that urges the lower pole upward.

BRIEF DESCRIPTION OF THE DRAWINGS

The following description of the invention will be more fully understood with reference to the accompanying drawings in which.

DESCRIPTION OF THE INVENTION

Figure 1:
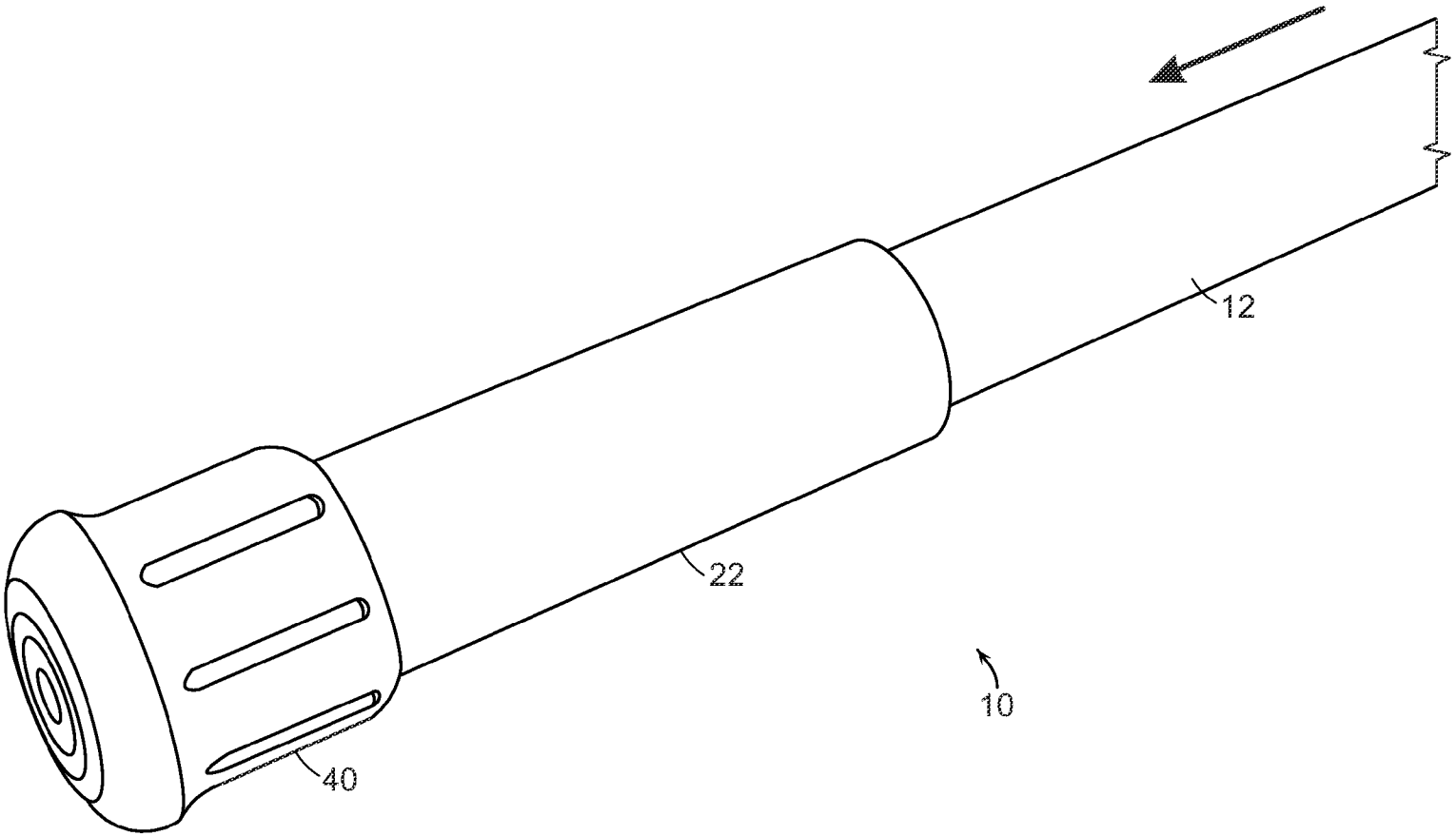
FIG. 1 is a perspective view of an adjustable lower pole assembly according to the present invention.
Figure 2:
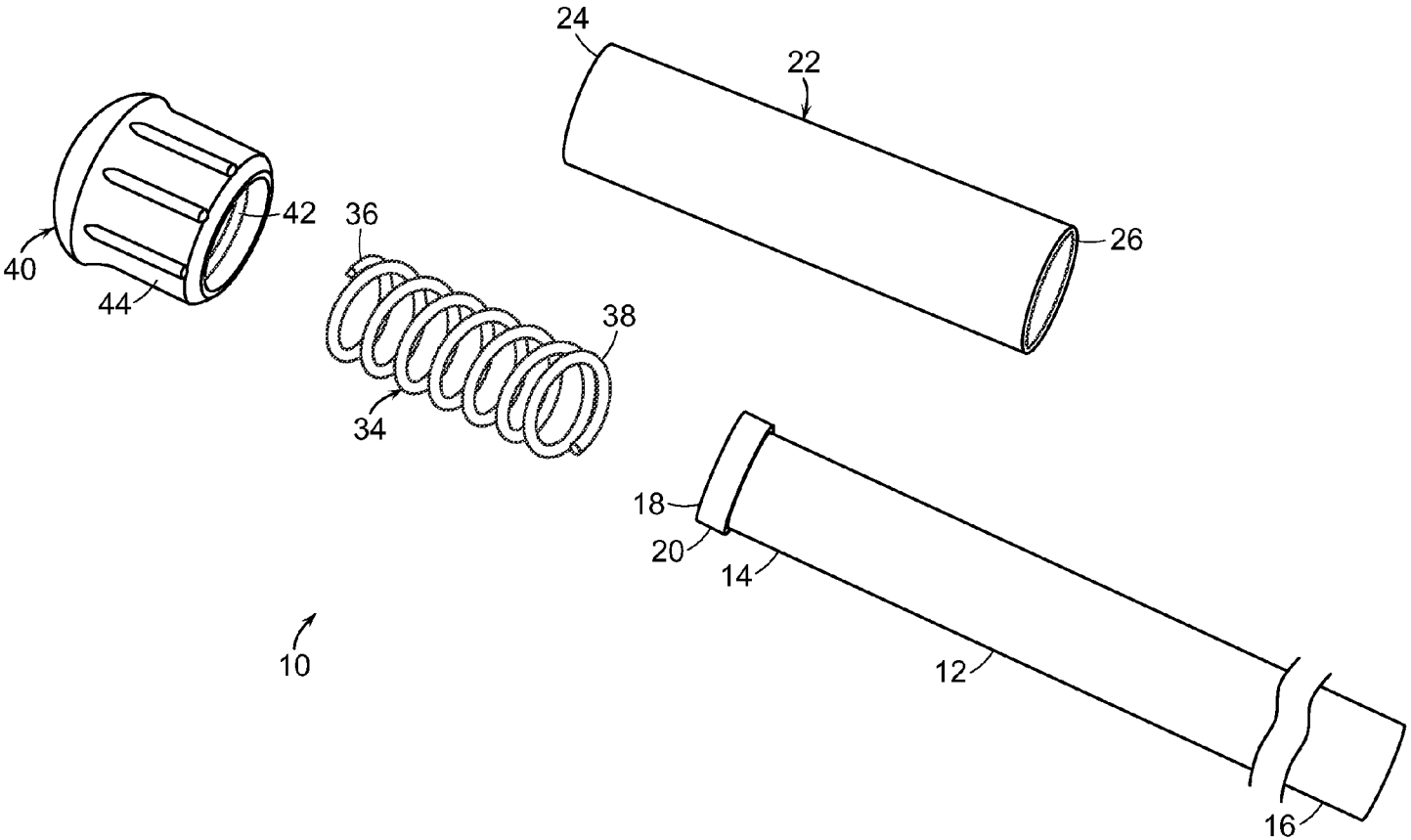
FIG. 2 is an exploded perspective view of the adjustable lower pole assembly according to the present invention.

Referring to FIGS. 1-2, the present invention is an adjustable lower pole assembly 10 that can be used in connection with an upper pole (not shown) that is typically telescopically mounted within the upper elongated body (not shown) of lower pole 10. Adjustable poles are useful to mount a temporary flexible wall. Adjustable lower pole 10 allows an operator to quickly mount the pole assembly (lower and upper poles) between the floor and ceiling with an upward applied force for stability and safety.

Adjustable lower pole assembly 10 generally comprises a pole 12 having a lower end 14 and an upper end 16 that may engaged with an upper pole (not shown). Pole 12 has an outside diameter of 0.875 inches and an inside diameter of 0.798 inches. Pole 12 is made from conventional stock metal tubing such as aluminum or steel and cut to the desired length.

Adjustable lower pole assembly 10 further comprises a stop member 18 mounted to lower end 14 of pole 12 by conventional means such crimping. Stop member 18 has an annular flange 20 extending outward of lower end 14 of pole 12 and an annular body (not shown) disposed within lower end 14 of pole 12. Stop member 18 is made from plastic and fabricated by conventional molding operations.

Figure 3:
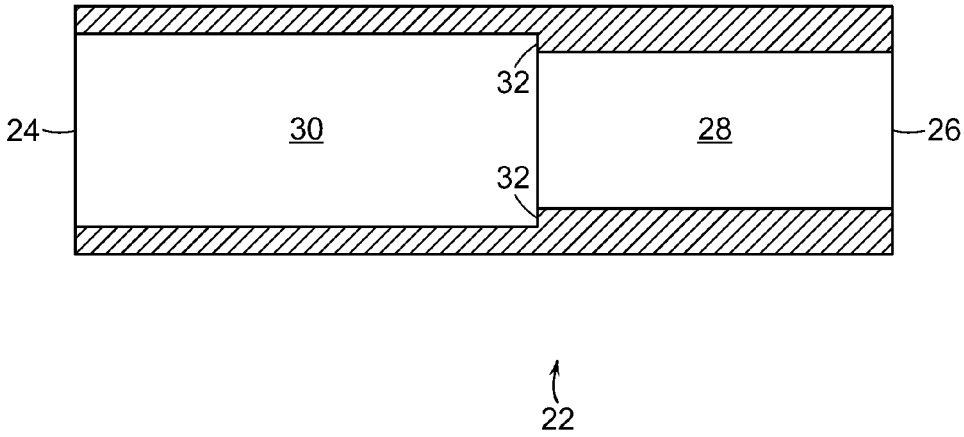
FIG. 3 is a cross section-view of a shroud according to the present invention.

Adjustable lower pole assembly 10 further comprises a shroud 22 mounted about lower end 14 of pole 12. As best shown by FIG. 3, shroud 22 comprises an upper end 26 disposed about lower end 14 of pole 12 and a lower end 24 extending outward from lower end 14 of pole 12. Shroud 22 further comprises an inner annular shoulder 32 adapted to engage with flange 20 of stop member 18 to prevent shroud 22 from falling of lower end 14 of pole 12. Shroud 22 further comprises a first passage way 28 extending inward from upper end 26 to shoulder 32. First passage way 28 has an inside diameter sufficient to allow free sliding movement of lower end 14 and pole 12 therein. Shroud 22 shroud further comprises a second passage 30 extending inward from lower end 24. Second passage way 30 has an inside diameter greater than the inside diameter of first passage way 28 to form shoulder 32. Shroud 22 is made from plastic and fabricated by conventional molding operations.

Adjustable lower pole assembly 10 further comprises a spring 34 having lower and upper ends 36 and 38. Spring 34 is a compression coil spring that is widely available.

Adjustable lower pole assembly 10 further comprises a cap 40 mounted about lower end 14 of pole 12. Cap 40 has an inner portion 42 and a flexible annular sidewall 44 sized to snugly fit about the outside surface of lower end 14. Cap 40 is made from rubber and is widely available.

Figure 4:
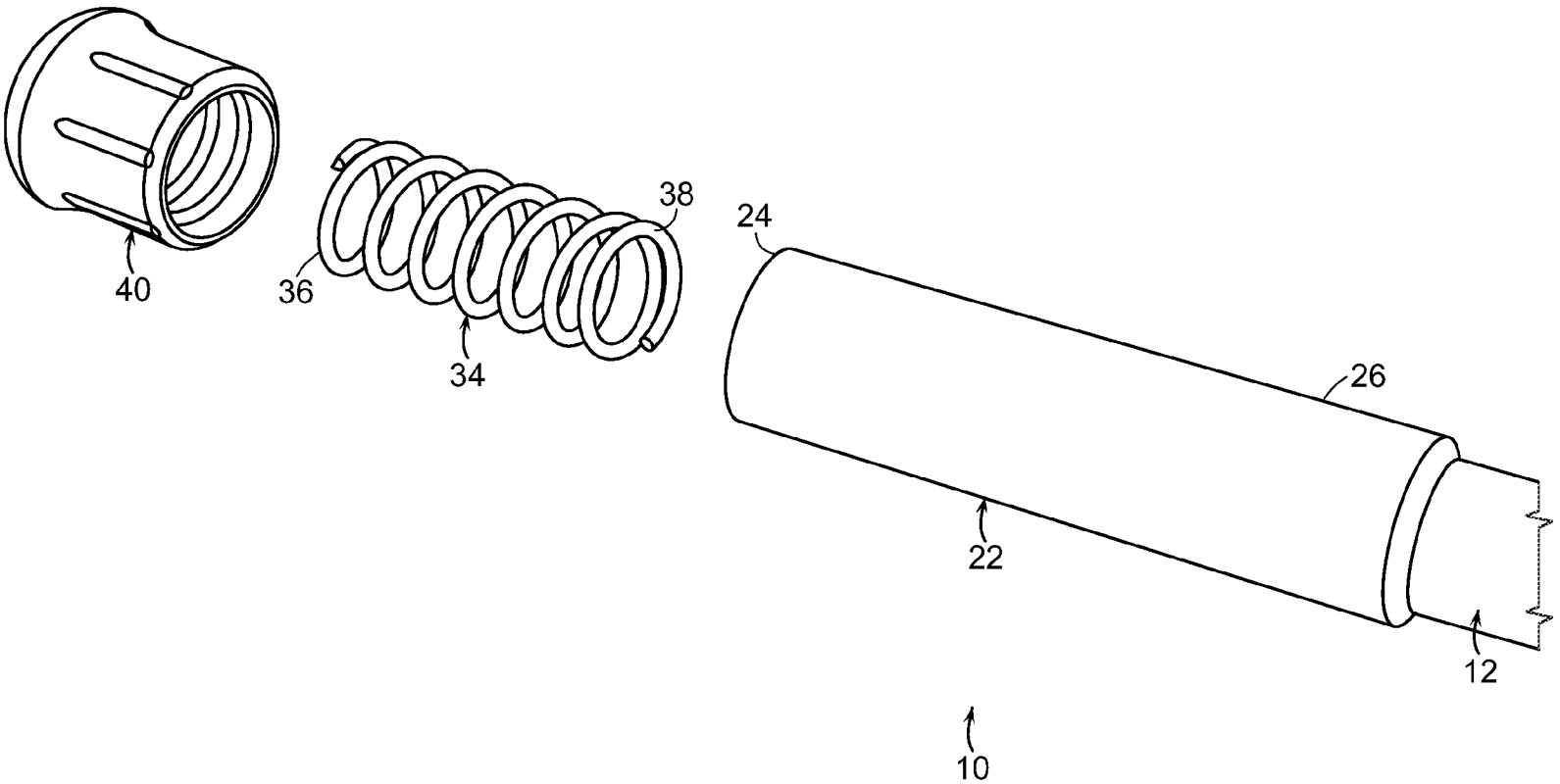
FIG. 4 is a partially exploded view of the adjustable lower pole assembly showing the shroud mounted to a lower end of a pole.
Figure 5:
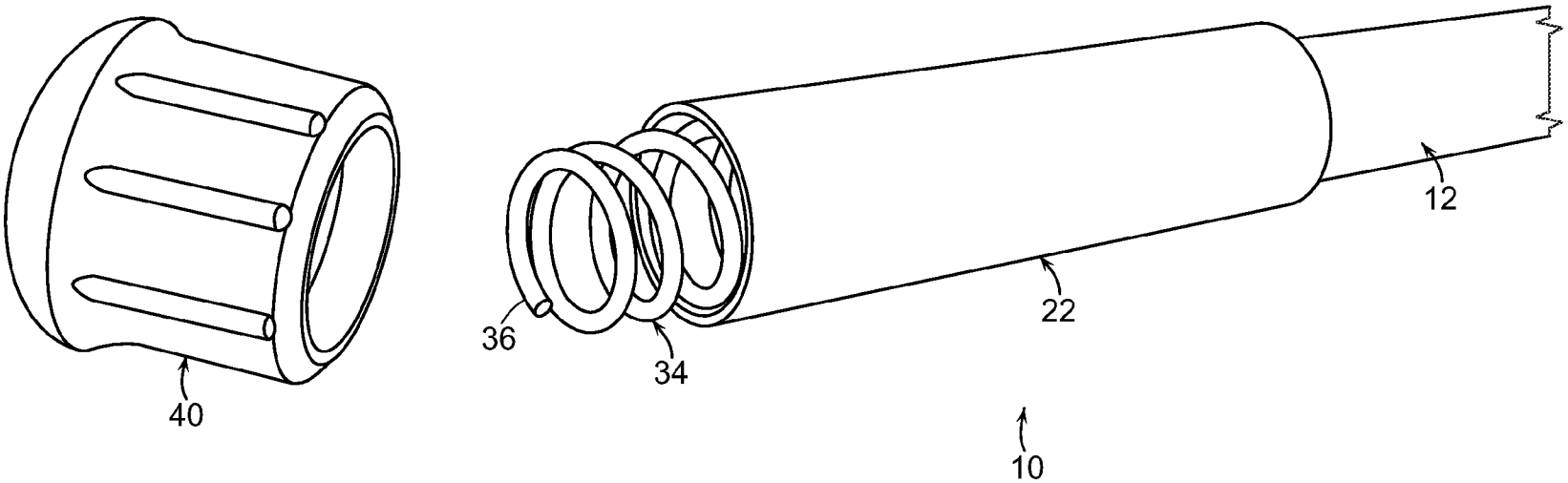
FIG. 5 is a partially exploded view showing the shroud mounted to the lower end of the pole and a spring inserted within the shroud.

Referring to FIGS. 4 and 5, adjustable lower pole assembly 10 is assembled by placing lower end 24 of shroud 22 over the upper end (not shown) of pole 12 and sliding shroud 22 down to lower end 14 until shoulder 32 abuts flange 20 of stop member 18 (FIG. 4). Thereafter, upper end 38 of spring 36 is then placed into lower end 24 of shroud 22 until spring 36 is substantially disposed within second passage 30 of shroud 22 (FIG. 5). The length of spring 36 in its unbiased state is substantially equal to the length of second passage 30 of shroud 22. Thereafter, cap 40 is placed about the outside surface of lower end 24 of shroud 22. In operation, lower end 14 of pole 12 may be moved downward within shroud 22 against spring 34 thereby creating a force in spring 34 that urges pole 12 upward.

In another embodiment, the present invention is a kit from quickly retrofitting an existing lower pole at a work site and a method thereof. The kit comprises a stop member 18, shroud 22, a spring 34 and a cap 40. In the field, an operator can remove the existing cap from the existing lower pole (or cut off the end of the lower pole) and attach stop member 18 by a crimping device. Thereafter, shroud 22 can be placed over the existing lower pole. Spring 23 is then inserted into the lower end 24 of shroud 22. Cap 40 is then secured about the outside surface of lower end 24 of shroud 22.

The foregoing description is intended primarily for purposes of illustration. This invention may be embodied in other forms or carried out in other ways without departing from the spirit or scope of the invention.

What is claimed is:

1. An adjustable lower pole assembly for use with an upper pole comprising:

a pole comprising a lower end;

a stop member engaged with said lower end of said pole; said stop member comprising a flange extending outward of said lower end of said pole;

a shroud comprising an upper end disposed about said lower end of said pole and a lower end extending outward from said lower end of said pole; said shroud further comprises an inner shoulder adapted to engage with said flange of said stop member to prevent said shroud from falling off said lower end of said pole; said shroud further comprises a first passage way extending inward from said upper end of said shroud to said shoulder; said shroud further comprises a second passage way extending inward from said lower end of said shroud to said shoulder; said pole passes thru said second passage way to said first passage way and said flange of said stop member is located in said second passageway engaged with said shoulder; each of said first and second passages ways has an inside diameter; said inside diameter of said second passage way is greater than said inside diameter of said first passage way;

a spring substantially disposed within said second passage way of said shroud; said spring having a lower end and an upper end engaged with said stop member;

a cap disposed about said lower end of said shroud and engaged with said lower end of said spring; and whereby said lower end of said pole may be moved downward within said second passage way of said shroud against said spring creating a force in said spring that urges said pole upward.

2. The lower pole assembly of claim 1, wherein said flange of said stop member is circular shaped.

3. The lower pole assembly of claim 2, wherein said spring is a compression coil spring.

4. The lower pole assembly of claim 3, wherein said cap is made from rubber.

5. The lower pole assembly of claim 4, wherein said shroud is made from plastic.

6. The lower pole assembly of claim 5, wherein said stop member is made from plastic.

7. A kit for retrofitting an existing lower pole having a lower end, the kit comprising:

a stop member adapted to engage with the lower end of said pole; said stop member comprising a flange extending outward of the lower end of the pole when said stop member is engaged with the lower end;

a shroud comprising an upper end disposed about said lower end of said pole and a lower end extending outward from said lower end of said pole; said shroud further comprises an inner shoulder adapted to engage with said flange of said stop member to prevent said shroud from falling off said lower end of said pole; said shroud further comprises a first passage way extending inward from said upper end of said shroud to said shoulder; said shroud further comprises a second passage way extending inward from said lower end of said shroud to said shoulder; said pole passes thru said second passage way to said first passage way and said flange of said stop member is located in said second passageway engaged with said shoulder; each of said first and second passages ways has an inside diameter; said inside diameter of said second passage way is greater than said inside diameter of said first passage way;

a spring substantially disposed within said second passage way of said shroud; said spring having a lower end and an upper end engaged with said stop member;

a cap disposed about said lower end of said shroud and engaged with said lower end of said spring; and whereby said lower end of said pole may be moved downward within said second passage way of said shroud against said spring creating a force in said spring that urges said pole upward.

8. The kit of claim 7, wherein said flange of said stop member is circular shaped.

9. The kit of claim 8, wherein said spring is a compression coil spring.

10. The kit of claim 9, wherein said cap is made from rubber.

11. The kit of claim 10, wherein said shroud is made from plastic.

12. The kit of claim 11, wherein said stop member is made from plastic.

* * * * *